US007013996B2

(12) United States Patent
Keskiniva et al.

(10) Patent No.: US 7,013,996 B2
(45) Date of Patent: Mar. 21, 2006

(54) IMPACT DEVICE

(75) Inventors: Markku Keskiniva, Tampere (FI); Jorma Mäki, Mutala (FI); Erkki Ahola, Kangasala (FI); Esa Rantala, Kyrönlahti (FI)

(73) Assignee: Sandvik Tamrock Oy, Tampere (FI)

( * ) Notice: Subject to any disclaimer, the term of this patent is extended or adjusted under 35 U.S.C. 154(b) by 0 days.

(21) Appl. No.: 10/749,381

(22) Filed: Jan. 2, 2004

(65) Prior Publication Data

US 2004/0226752 A1 Nov. 18, 2004

Related U.S. Application Data

(63) Continuation of application No. PCT/FI02/00590, filed on Jul. 1, 2002.

(30) Foreign Application Priority Data

Jul. 2, 2001 (FI) ..... 20011434

(51) Int. Cl.
*E21B 1/28* (2006.01)

(52) U.S. Cl. ..... 175/135; 173/201; 175/189

(58) Field of Classification Search ..... 175/135, 175/189, 56, 298; 173/200, 201, 14
See application file for complete search history.

(56) References Cited

U.S. PATENT DOCUMENTS

| | | | | |
|---|---|---|---|---|
| 879,971 | A * | 2/1908 | Locke | 175/212 |
| 3,162,252 | A * | 12/1964 | Holland et al. | 173/91 |
| 3,417,828 | A * | 12/1968 | Duyster et al. | 405/232 |
| 3,570,609 | A | 3/1971 | Wise | |
| 3,583,498 | A * | 6/1971 | Dorm | 173/204 |
| 3,662,843 | A | 5/1972 | Wise | |
| 3,792,738 | A | 2/1974 | Mori et al. | |
| 3,887,018 | A | 6/1975 | Jayne | |
| 4,082,152 | A | 4/1978 | Whitworth | |
| 4,159,039 | A * | 6/1979 | Kasuga et al. | 173/1 |
| 4,256,187 | A | 3/1981 | Barnard | |
| 4,930,584 | A * | 6/1990 | Chaur Ching et al. | 173/200 |
| 4,993,504 | A * | 2/1991 | Rodert et al. | 175/135 |
| 5,289,887 | A * | 3/1994 | Puttmann | 175/61 |

FOREIGN PATENT DOCUMENTS

| | | |
|---|---|---|
| EP | 1 070 569 A1 | 12/1998 |
| GB | 2 328 342 A | 6/1997 |
| WO | WO 97/26090 | 1/1997 |

* cited by examiner

*Primary Examiner*—Hoang Dang
(74) *Attorney, Agent, or Firm*—Drinker Biddle & Reath LLP

(57) ABSTRACT

An impact device for a rock drill. The rock drill includes a tool and a mechanism for delivering a stress pulse to the tool. That mechanism includes an impact element supported to a frame of the drill, and a mechanism for subjecting the impact element to stress and thereafter releasing the impact element suddenly from the stress, whereupon stored stress energy in the impact element is discharged in the form of a stress pulse directed at the tool.

9 Claims, 3 Drawing Sheets

Figure 1:
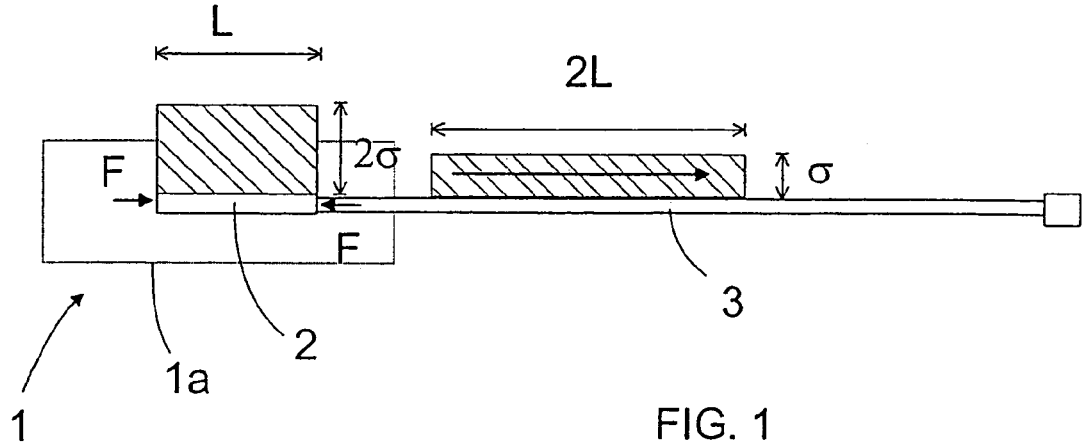

FIG. 5
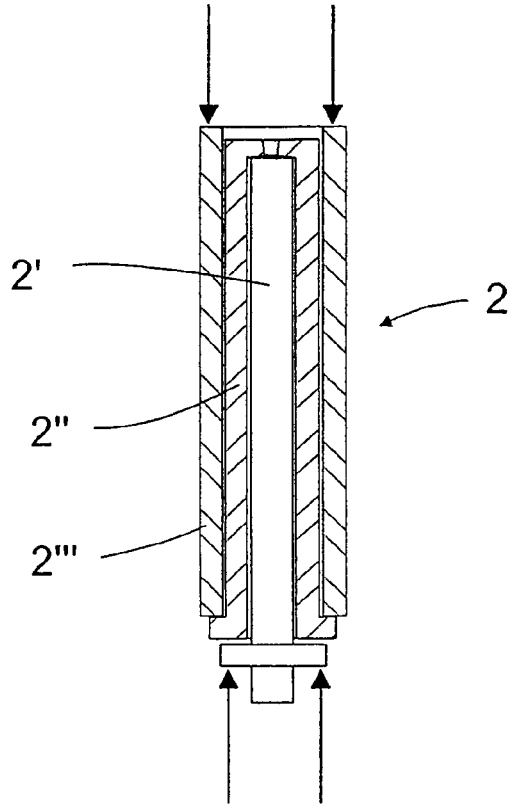
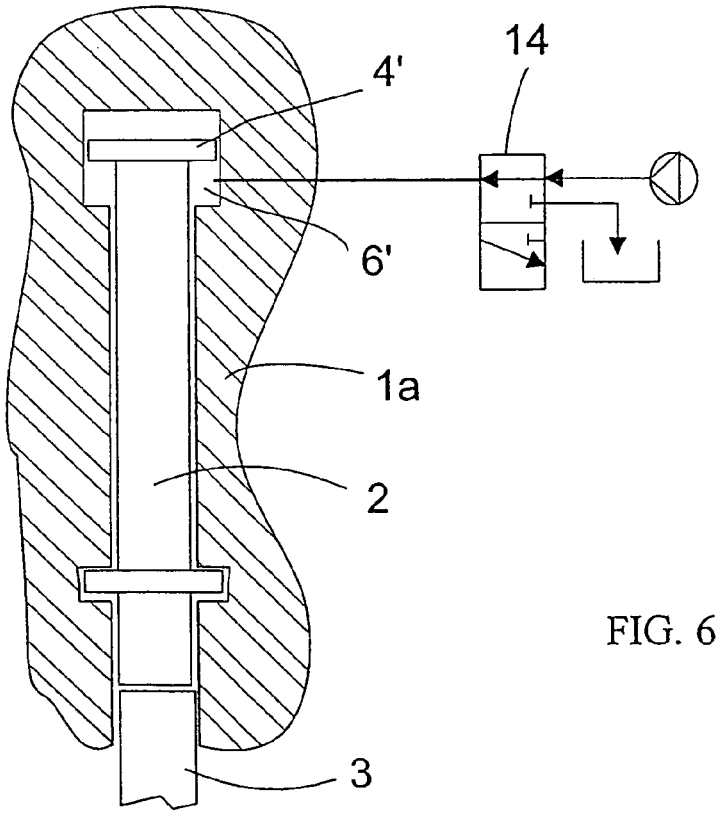
FIG. 6

IMPACT DEVICE

CROSS-REFERENCE TO RELATED APPLICATIONS

This is a continuation of International Application No. PCT/FI02/00590, with an International filing date of Jul. 1, 2002, designating the United States, claiming the priority of Finnish Application No. 20011434, filed Jul. 2, 2001, and published in English by the International Bureau on Jan. 16, 2003, as WO 03/004822. Priority of the above-mentioned applications is claimed and each of the above-mentioned applications are hereby incorporated by reference in their entirety.

The invention relates to an impact device for a rock drill or the like, comprising means for delivering a stress pulse at a tool connected to the impact device.

In prior art impact devices, a stroke is generated by means of a reciprocating percussion piston, which is typically driven hydraulically or pneumatically and in some cases electrically or by means of a combustion engine. A stress pulse is generated in a tool, such as a drill rod, when the percussion piston strikes an impact surface of either a shank or a tool.

A problem with the prior art impact devices is that the reciprocating movement of the percussion piston produces dynamic accelerating forces that complicate control of the apparatus. As the piston accelerates in the direction of impact, the drill tends to simultaneously move in the opposite direction, thus reducing the compressive force of the end of the drill bit or the tool with respect to the material to be processed. In order to maintain a sufficiently high compressive force of the drill bit or the tool against the material to be processed, the impact device must be pushed sufficiently strongly towards the material. This, in turn, requires the additional force to be taken into account in the supporting and other structures of the impact device, wherefore the apparatus will become larger and heavier and more expensive to manufacture. Due to its mass, the percussion piston is slow, which restricts the reciprocating frequency of the piston and thus the striking frequency, although it should be significantly increased in order to improve the efficiency of the impact device. However, in the present arrangements this results in far lower efficiency, wherefore in practice it is not possible to increase the frequency of the impact device.

An objective of the present invention is to provide an impact device where the dynamic forces generated by impact operation have less disadvantageous effects than in the prior art arrangements, such devices enabling easier increase of the reciprocating frequency. The impact device according to the invention is characterized by what is disclosed in the appended claims.

According to a basic idea of the invention, a stroke is provided by one or more elastic impact elements, which are subjected to a stress state for storing energy for each stroke. In the stress state, the length of the element changes with respect to its length in a non-stress state, and the stress state of the impact element is suddenly released, whereupon the element tends to return to its rest length and to deliver a stroke, or to direct a stress pulse, at the tool by means of the stored stress energy.

The invention has the advantage that an impulse-like impact movement generated as described above does not require a reciprocating percussion piston, but the change in the length of the elastic impact element is in the order of a millimetre. As a result, there is no need to move large masses back and forth in the impact direction, and the dynamic forces are small compared to the dynamic forces generated by the heavy reciprocating percussion pistons used in the prior art arrangements. Furthermore, such a structure enables an increase of the reciprocating speed without essential deterioration of efficiency.

Figure 2:
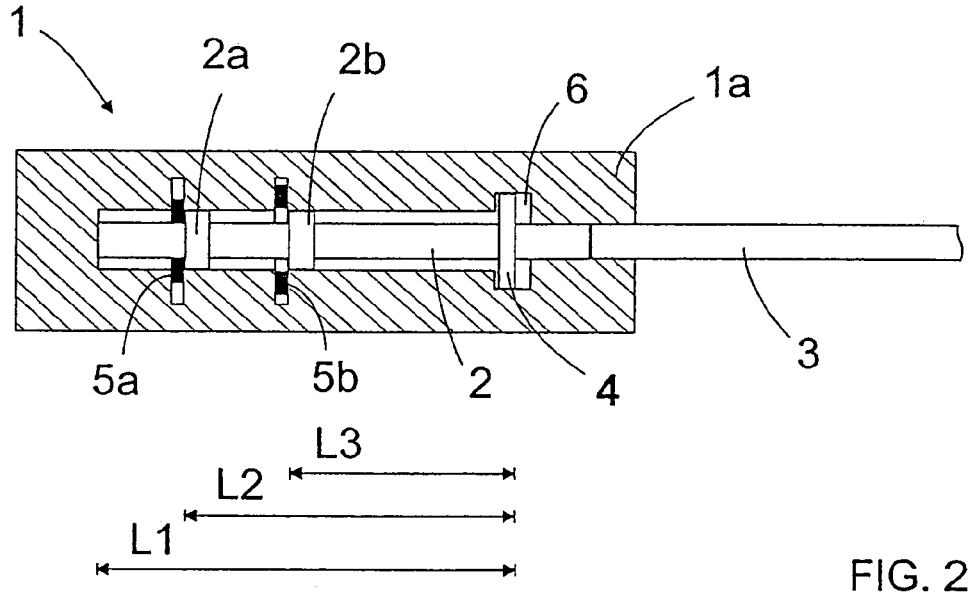
Figure 3:
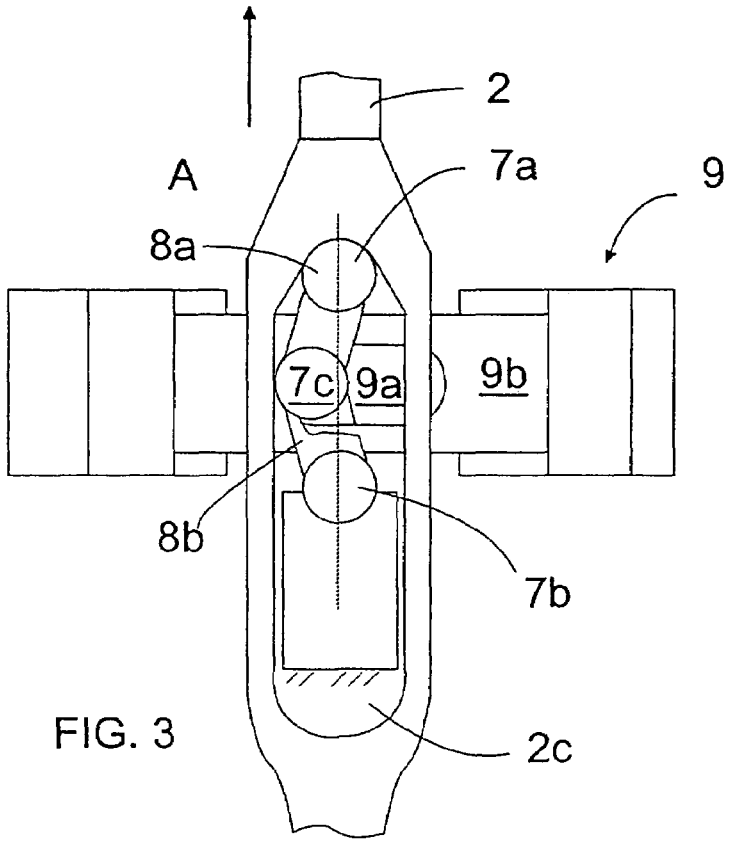
Figure 4:
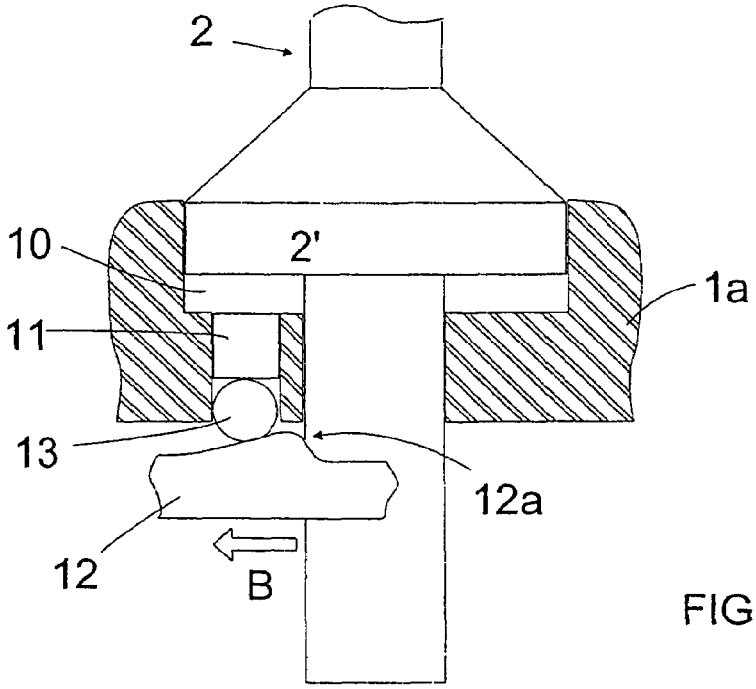

The invention will be described in more detail in the accompanying drawings, in which FIG. 1 shows schematically an operating principle of an impact device according to the invention, FIG. 2 shows schematically an embodiment of an impact device according to the invention, FIG. 3 shows schematically another embodiment of the impact device according to the invention, FIG. 4 shows schematically a third embodiment of the impact device according to the invention, FIG. 5 shows schematically a fourth embodiment of the impact device according to the invention, and FIG. 6 shows an embodiment of an impact element according to the invention.

FIG. 1 shows schematically an operating principle of an impact device according to the invention. A broken line in the figure shows an impact device 1 and a frame 1*a* thereof, which encloses an elastic impact element 2. The impact element 2 is compressed or alternatively stretched to such an extent as to change the length of the element compared to its rest length. In a practical implementation, this change is of the order of a millimetre, i.e. for example between 1 and 2 mm. Straining the impact element naturally requires energy, which is directed at the element 2 either mechanically, hydraulically or hydromechanically, as shown by means of practical examples in FIGS. 2 to 6.

When the impact element is prestressed, e.g. compressed a shown by way of an example in the figure, the impact device 1 is pushed forward so that an end of a tool 3 is pressed firmly against the end of the impact device either directly or via a separate connecting piece, such as a shank or the like. In such a situation, the impact element is suddenly released from compression, whereupon it tends to return to its natural length. As a result, a stress wave is generated in the drill rod or some other tool, and in propagating to the tool end the wave produces a stroke in the material to be processed, similarly as in the prior art impact devices.

In theory, without losses the ratio of the impact element and the prestress thereof or the propagating stress wave, respectively, is such that the length of the stress wave is twice the length of the strained part of the impact element, and correspondingly the strength of the stress wave is half the stress reserved in the impact element for the impact. In practice, these values change due to losses.

FIG. 2 shows schematically an embodiment of an impact device according to the invention, where the impact element 2 is located with respect to the frame 1*a* of the impact device such that the element's end situated away from the tool 3 is supported to the frame 1*a* of the impact device 1 and the element is compressed at the end near the tool 3 by a hydraulic piston 4. The figure further shows schematically support jaws 5*a* and 5*b*, and corresponding shoulders 2*a* and 2*b* situated in the impact element 2. If the behaviour and the pulse properties of the impact element are to be varied, it is possible to use either the entire length $L_1$ of the impact element 2 beginning from the piston, or one of the corresponding shoulders 2*a*, 2*b*, the corresponding support jaws and the respective length $L_2$ or $L_3$ of the impact element 2 to be stressed.

If the entire length of the impact element 2 is used, the element is compressed schematically by means of hydraulic fluid supplied to a pressure space 6 behind the piston 4, so that the entire length of the impact element shown to the left of the piston 4 in the figure will be strained. As a result, the length of the impact pulse is approximately twice $L_1$. If a shorter impact pulse of a different shape is desired, for example the support jaws 5*a* are made to rest on corresponding shoulder 2*a*, and when the impact element 2 is prestressed, it compresses only at the length between the piston 4 and corresponding shoulder 2*a*. Consequently, the length of the stress wave propagating to the tool 3 due to the stroke is approximately twice $L_2$. An even shorter stress wave is obtained by means of corresponding shoulder 2*b* and support jaws 5*b*. The operating properties of the impact device can thus be changed suitably according to the current tool and the working conditions.

FIG. 3 shows another embodiment of the impact device according to the invention. In this embodiment, the impact element is strained by means of a separate pivot mechanism, which is driven by a hydraulic piston mechanism moving transversely to the impact element. The pivot mechanism comprises support elements 7*a* and 7*b* that are parallel to an axis transverse to the central axis of the impact element. Between the support elements there is an actuator 7*c*, which is supported via supporting arms 8*a* and 8*b* to elements 7*a* and 7*b*. The piston 9 in turn comprises an elongated opening 9*a* in the middle, the actuator 7*c* extending thereto. In a more preferable arrangement, the piston 9 comprises two transverse rods 9*b* on both sides of the impact element 2, so that the forces acting on the actuator 7*c* are symmetrically in balance. When the piston 9 is moved to the right in the figure, it pushes the actuator 7*c* in the same direction, thus forcing, via the supporting arms 8*a* and 8*b*, the support elements 7*a* and 7*b* to move further apart, whereupon a force is generated in the impact element 2 in a direction denoted by arrow A. When the actuator 7*c* crosses the centre line between the support elements 7*a* and 7*b*, it is able to swing freely to the right in the figure, whereupon the support elements 7*a* and 7*b* will be again able to move closer together and the tension in the impact element 2 is released in the form of a stress pulse directed at the tool. Correspondingly, when the piston 9 is moved to the left in the figure, the pivot mechanism is similarly lengthened and rapidly shortened in the opposite direction, thus resulting in a new stress pulse directed at the tool.

FIG. 4 shows schematically a third embodiment of the impact device according to the invention. The figure shows straining of the impact element 2 by means of a hydromechanical arrangement. In this arrangement, the impact element comprises a shoulder 2' situated with respect to the frame of the impact device such that a pressure fluid space 10 is formed between the annular shoulder and the impact device. Hydraulic fluid is first supplied to this space 10 at a normal hydraulic feed pressure. The impact element 2 can be subjected to different stress, and the shape and strength of the stress pulse formed can thus be adjusted by varying the pressure of the hydraulic fluid to be fed, or the prestress pressure. The pressure fluid space 10 is thereafter closed and a separate booster piston 11, which is driven by a mechanical trigger element 12, is also used. Between the trigger element 12 and the booster piston 11 there is a separate bearing cylinder 13. The trigger element further comprises a shoulder 12*a* facing the bearing cylinder 13, the cylinder rotating along the shoulder during use. In this embodiment, when the trigger element is moved in a direction indicated by arrow B, i.e. to the left in the figure, after the pressure fluid space 10 has been filled with hydraulic fluid of a desired pressure, the element pushes the booster piston 11 towards the pressure fluid space 10 due to the shoulder 12*a* of the bearing cylinder 13. Since a pressure fluid channel leading to the pressure fluid space 10 was closed before the trigger element 12 started moving, the space 10 is enclosed and the insertion of the booster piston 11 towards the space 10 reduces the volume and increases the pressure, thus further straining the impact element 2. When the trigger element has moved to such an extent that the bearing cylinder 13 is able to move away from the piston 11, and the bearing cylinder 13 and the piston 11 are thus able to move rapidly due to the abrupt shape of the shoulder 12*a*, the stress is quickly released from the impact element to the tool not shown in the figure. The speed can be increased e.g. by opening a channel from the pressure fluid space 10 to a pressure medium space or some other space substantially simultaneously, so that the hydraulic fluid can flow thereto from the pressure fluid space 10 with as small losses as possible. When the trigger element is moved to the right in the figure, the working phase can be restarted and repeated to obtain a desired reciprocating frequency.

The mechanical structure of the booster piston 11 can be replaced with a hydraulic structure. In such a structure as shown in FIG. 4, the end of the booster piston 11 opposite to the pressure space 10 is provided with a pressure surface, which is greater than the pressure surface facing the space 10. This greater pressure surface is thereafter provided with a normal pressure of pressure medium, so that the surface pushes the booster piston 11 towards the pressure space 10 until the product of the pressure acting on each side and the corresponding surface area is the same in each side of the booster piston. When pressure medium is again allowed to flow rapidly out of either the space 10 or the space behind the booster piston 11, the tension in the impact element 2 is quickly discharged, which results in a stress pulse in the tool.

FIG. 5 shows a fourth embodiment of the impact device according to the invention. This embodiment utilizes several impact elements connected in series and strained simultaneously. This can be implemented e.g. by using a solid rod as the middlemost impact element, and sleeve-like elements imposed on each other around the rod. In the figure, these sleeve-like elements 2' and 2''' are shown in a sectional view for the sake of illustration. In this embodiment, the end of each sleeve-like element is provided with a shoulder, against which the middle rod or the next sleeve-like element is supported. During the use of this embodiment, the operating length of the impact element is the sum of the lengths of all the anterior impact elements 2' to 2'''. By means of this embodiment, the practical length of the impact device can be shortened by one whole impact element, while maintaining the properties of the stress pulse obtained by the impact element. As is the case with impact elements connected in series as described above, the innermost rod-like impact element 2' and the outermost sleeve-like impact element 2''' are subjected to a compressive force by way of an example, whereas the middlemost sleeve-like impact element 2'' situated between the two other elements is subjected to tensile stress. Therefore, in such an arrangement every other impact element is subjected to compression stress and every one other one to tensile stress. The aforementioned matter is of no significance to the operation of the stress pulse formed in the tool, but the result is the same as with a stress pulse provided by means of compression or tensile stress of a uniform impact element corresponding to the sum of the lengths of the impact elements.

The figure also shows a structure of an impact element suitable for implementing the impact device according to the invention. In this embodiment, the impact element is formed of several parallel components, which are of the same length, however. Correspondingly, the length of the impact element is equal to the length of these components, and in other respects the element corresponds to an individual impact element of the same length and with a corresponding cross-section.

FIG. 6 shows schematically an embodiment where the impact element is stretched instead of compression to store energy and to provide desired stress. In this embodiment, the impact element 2 is supported from its front to the end near the tool of the impact device, so that the element cannot move towards the rear of the impact device frame. Correspondingly, the opposite end of the impact element is provided with a piston 4', so that a pressure fluid space 6' is formed between the frame of the impact device and the piston 4' on the side of the piston 4' facing the tool. In this embodiment, the impact element is stretched by means of hydraulic fluid until the desired stress state is obtained. To provide a stroke, the hydraulic fluid in the pressure fluid space 6' is suddenly allowed to flow by means of a valve 14 shown schematically in the figure, so that the impact element 2 is shortened to its normal length, which results in a stress pulse propagating to the tool 3.

Transfer of the stored energy from the impact element to the tool requires the stress to be released rather quickly. However, if the strength and length of the stress pulse transferred to the tool is to be adjusted, it is possible to utilize the release rate of the impact element. In other words, when the impact element is released more slowly, the strength of the stress pulse propagating to the tool can be decreased and the length thereof increased, whereupon the properties of the stroke delivered by the tool at the material to be processed change correspondingly. Even in this case the stress of the impact element is released rather rapidly. In another alternative embodiment of the impact element, one or more parallel solid elements are replaced with a tubular element, if required for constructional reasons.

The invention is described in the above specification and in the drawings only by way of an example and it is not restricted thereto in any way. The essential feature is that a stress pulse is generated in the tool by means of an impact element that is subjected to either compression or tensile stress by a desired force to provide a desired stress state, whereafter the impact element is suddenly released from the stress state so that the tension is discharged either directly or indirectly to the end of the tool and further to the tool.

What is claimed is:

1. A rock drill comprising a tool and means for delivering a stress pulse to the tool comprising an impact element supported to a frame of the rock drill and means for subjecting the impact element to stress to store stress energy in the impact element and correspondingly for releasing the stressed impact element suddenly from the stress, whereupon the stress energy stored in the element is discharged in the form of a stress pulse directed at the tool, the means for subjecting the impact device to stress comprising a pressure fluid space, a shoulder provided in the impact element and facing said pressure fluid space, and means for feeding hydraulic fluid to the pressure fluid space and for releasing pressure from the space, wherein the means for releasing pressure from the pressure fluid space comprise means for discharging pressurized hydraulic fluid from said pressure fluid space, the impact element being subjected to stress by feeding pressurized hydraulic fluid to said pressure fluid space and released from stress by allowing the hydraulic fluid to suddenly flow out of said pressure fluid space.

2. The rock drill according to claim 1, further comprising a booster piston in connection with said pressure fluid space, and means for transferring the booster piston towards the pressure fluid space so that the volume of the space decreases and the pressure in said space increases, and means for freeing the booster piston to move away from the pressure fluid space, so that the volume of the space increases and the pressure in said space correspondingly decreases.

3. The rock drill according to claim 2, wherein the booster piston is pushed towards said pressure fluid space by a mechanical trigger element.

4. The rock drill according to claim 3, wherein a separate bearing cylinder is provided between the trigger element and the booster piston, the trigger element comprising a shoulder which faces the bearing cylinder and along which the cylinder rotates, wherein after the trigger element has moved a sufficient distance, the bearing cylinder and the booster piston are able to move rapidly away from said pressure fluid space so as to generate a stress pulse.

5. The rock drill according to claim 1, wherein the impact element has at least two corresponding shoulders located one after another in the longitudinal direction of the element, and locking means for locking a desired corresponding shoulder immovably in the axial direction of the impact device.

6. The rock drill according to claim 1, wherein the impact element is formed of at least two separate impact elements connected in series in the longitudinal direction to act on one another so that the stress length of the impact element is the combined stress length of the impact elements connected in series.

7. Impact device for a rock drill or the like, comprising means for delivering a stress pulse at a tool connected to the impact device, wherein the means for delivering a stress pulse comprise an impact element supported to a frame of the impact device and means for subjecting the impact element to stress and correspondingly for releasing the impact element suddenly from the stress, whereupon the stress energy stored in the element is discharged in the form of a stress pulse directed at the tool that is directly or indirectly connected to the impact element and that the means for subjecting the impact device to stress comprise a pressure fluid space, and a shoulder provided in the impact element and facing said pressure fluid space, and means for feeding hydraulic fluid to the pressure fluid space and for releasing pressure from the space, wherein the impact element is formed of at least two separate impact elements connected in series in the longitudinal direction to act on one another so that the stress length of the impact element is the combined stress length of the impact elements connected in series.

8. The impact device according to claim 7, wherein at least some of the impact elements are substantially sleeve-like and placed coaxially with respect to one another.

9. Impact device for a rock drill or the like, comprising means for delivering a stress pulse at a tool connected to the impact device, wherein the means for delivering a stress pulse comprise an impact element supported to a frame of the impact device and means for subjecting the impact element to stress and correspondingly for releasing the impact element suddenly from the stress, whereupon the stress energy stored in the element is discharged in the form of a stress pulse directed at the tool that is directly or indirectly connected to the impact element and that the means for subjecting the impact device to stress comprise a pressure fluid space, and a shoulder provided in the impact element and facing said pressure fluid space, and means for feeding hydraulic fluid to the pressure fluid space and for releasing pressure from the space, wherein the impact element has at least two corresponding shoulders located one after another in the longitudinal direction of the element, and locking means for locking a desired corresponding shoulder immovably in the axial direction of the impact device.

* * * * *